US005403116A

United States Patent [19]

Brewer

[11] Patent Number: 5,403,116

[45] Date of Patent: Apr. 4, 1995

[54] BOOTED ROAD PLATE

[75] Inventor: Thomas A. Brewer, Anderson, Ind.

[73] Assignee: Bastin-Logan Water Services, Inc., Franklin, Ind.

[21] Appl. No.: 105,719

[22] Filed: Aug. 12, 1993

[51] Int. Cl.[6] ..... E01F 5/00; E02D 29/14

[52] U.S. Cl. ..... 404/25; 137/371

[58] Field of Search ..... 404/25, 26, 2; 52/19, 52/20, 170; 405/36, 259.4; 137/364, 371; 239/200, 201; 166/81, 92, 96; 403/297; 411/34, 49–54, 44, 15

[56] References Cited

U.S. PATENT DOCUMENTS 1,345,214 6/1920 Moore .
4,325,405 4/1982 Christo ..... 137/371
4,461,597 7/1984 Laurin ..... 52/20 X
4,475,844 10/1984 Arntyr et al. ..... 404/2
4,579,491 4/1986 Kull .
4,690,597 9/1987 Liebig .
4,714,391 12/1987 Bergner .
4,765,541 8/1988 Mangels et al. .
5,253,952 10/1993 Selway ..... 404/25

*Primary Examiner*—Ramon S. Britts
*Assistant Examiner*—James A. Lisehora
*Attorney, Agent, or Firm*—Barnes & Thornburg

[57] ABSTRACT

A booted road plate includes a plate and an anchoring device appended to the underside of the plate. The plate is sized to cover an excavated repair area to allow vehicular and pedestrian traffic to pass over the excavated repair area without harming the vehicle, pedestrian, or repair area. The anchoring device holds the plate in place over the excavated repair area.

32 Claims, 4 Drawing Sheets

BOOTED ROAD PLATE

BACKGROUND AND SUMMARY OF THE INVENTION

The present invention relates to a road plate assembly for covering areas of repair in a roadway driving surface. More particularly, the present invention relates to a booted road plate which is arranged to cover an area of repair in a roadway surface and anchored in place to resist movement caused by vehicles traveling on the roadway surface.

The invention is directed to the field of utility work where water valves, gas valves, and manholes exist within the confines of driving surfaces. This invention is particularly aimed toward the repair and/or replacement of utility valve boxes and manholes where minor excavations have occurred.

The utility gas or water valve boxes or manholes are buried underground and can be used to gain access to underground water or gas pipelines. One reason access to the pipelines is required is to allow utility companies to actuate valves in the pipelines to move such valves between an open and closed position to control the flow of water or gas through the underground pipeline.

Repair work on the buried utility valve boxes is performed usually to replace a faulty valve box, raise the top of the valve box to street level after street resurfacing, or gain access to valve boxes which have been paved over during street resurfacing. Many utility valve boxes are located in or under roadways and the roadway must be excavated to gain access to the repair area. A vehicle traveling on the roadway can be damaged if it is allowed to drive into the excavated area around the valve box under repair. Vehicle intrusion into an excavated repair area can also lead to damage of the valve box or further destruction of the repair area. Therefore to allow vehicle traffic to pass into the excavated repair area when repair operations are not being conducted, such as during nights, week-ends, bad weather, or the waiting time for concrete poured around a valve into the repair area to cure, etc., the excavated repair area around the valve box must be covered.

It is known to use barricades or workers with flags to divert traffic away from an area on a roadway that is under repair. However, these barricades and workers hinder traffic movement on the roadway.

Conventional road plate assemblies for covering excavated areas of repair in a roadway driving surface generally include large, approximately 4 feet×8 feet (1.22 meters×2.44 meters), steel plates, weighing approximately 1,000 pounds (454 Kg), to cover the area of repair as shown in FIG. 1. The conventional road plates 10 are large enough to cover big holes and heavy enough to resist displacement by street traffic. Nevertheless, the large steel plates 10 must often be held in place using nails or pins 12 driven through holes provided in the plate 10 or around the edge of the plate 10 and into the driving surface 14 or underlying ground 16 to ensure secure placement. Installation of the large steel plates 10 over an excavated repair area 18 requires a mechanized lifting device 20 such as a backhoe or small crane. The large steel plates 10 also require a lifting device to load the plates onto a truck or trailer for transport to and from a repair work site.

It would be advantageous to provide a road plate assembly which has a minimum size and weight. A road plate assembly with a minimum size and weight increases ease of installation by allowing installation by one or two workers rather than a mechanized lifting device and increases ease of moving the road plate assembly to and from the work site. The cost of the repair work is advantageously decreased by reducing the number of workers and time and the amount of mechanized equipment required to transport and install the road plate assembly.

According to the present invention, a booted road plate assembly is provided to cover an excavated repair area. The booted road plate assembly includes a plate sized to cover the excavated repair area and an anchoring device appended to the underside of the plate and configured to hold the road plate in place over an excavated repair area.

One feature of a road plate assembly in accordance with the present invention is that the road plate has a reduced size and weight compared to a conventional road plate. The improved road plate does not need to be as large and heavy as conventional road plates because it has an anchoring device mounted on its underside that is arranged to engage an underground fixture in the area under repair so that the road plate is held in place over the area under repair. This improved small and lightweight road plate assembly minimizes the labor and equipment costs associated with roadway repairs involving excavated holes which must be covered temporarily by a road plate of some sort.

The booted road plate is a steel road plate with the unique ability to lock into and onto existing roadway boxes, gas and water valve boxes, manholes, and other underground fixtures. This permits the unobstructed movement of traffic on a roadway even before street resurfacing around the utility fixture has cured or has even been performed.

In a preferred embodiment of the present invention, the road plate anchoring device includes a shaft that is appended to the bottom side of the plate and arranged to extend downwardly at a right angle to the road plate a predetermined distance into an underground utility valve box or the like. A boot is attached to the distal end of the shaft and the boot has a diameter greater than the diameter of the shaft. The boot is arranged to lie in coaxial relation to the shaft.

Typically, a utility valve box is buried underground beneath a roadway and is connected to an underlying piping system. The utility valve box is formed to include a cylindrical tube that extends downwardly into the ground a predetermined distance. Generally, some digging into the road and the underlying ground is needed to perform necessary repairs to the buried utility valve box.

Illustratively, the outer diameter of the boot is approximately 0.25 inches (0.635 centimeters) less than the inside diameter of the cylindrical tube formed in the utility valve box, manhole, or other underground fixture. Therefore, it will be understood that the outside diameter of the boot can be sized to match any size of utility valve box or underground fixture.

Advantageously, the road plate boot is configured to fit snugly inside a vertical passageway formed in the buried utility valve box or underground fixture. The road plate boot may only move straight up and down in the vertical valve box passageway, therefore no lateral or angular movement of the overlying road plate can occur. The diameter of the boot is larger than the diameter of the shaft to allow only the boot to engage the utility valve box. Therefore, forces imparted to the road plate due to roadway traffic are transmitted down to the underlying boot where structural integrity is the greatest and at a point deep down away from the road plate, roadway, and portions of the utility valve box in the area under repair. This feature of the invention prevents forces due to roadway traffic from impairing the condition of the repair operations such as freshly poured concrete or repair parts installed at the roadway surface.

In an alternative embodiment, the booted road plate includes a road plate covering the area under repair, a hollow shaft including a proximal end appended to the bottom side of the plate that extends downwardly into the utility valve box or manhole to a distal end of the hollow shaft, and a boot assembly at the distal end of the shaft. The boot assembly includes a boot-expanding member or tapered boot appended to the distal end of the shaft and a threaded rod. The threaded rod is appended to the top side of the plate and arranged to extend through the hollow shaft and into threaded engagement with a compression plate and nut downward of the boot-expanding member.

The boot assembly also includes an expandable boot or expansion boot appended to the top side of the compression plate. Rotational movement is imparted to the threaded rod to raise the expandable boot into compressive engagement with the boot-expanding member. When the boot-expanding member and expandable boot are squeezed together, the boot-expanding member acts to expand the expandable boot to a radially expanded position engaging the cylindrical inner wall of the utility valve box to anchor the shaft in a utility valve box.

One feature of the road plate assembly in accordance with the alternative embodiment is that the expandable boot in its radially expanded position is engaged with the inner wall of the utility valve box. The road plate assembly will be frictionally engaged with the utility valve box and thus no movement of the booted road plate is expected to occur. This alternative embodiment prevents the road plate from bouncing up and down due to roadway traffic.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 3 is a perspective view of the booted road plate assembly of FIG. 2 showing the underside of the road plate, a shaft attached to the underside of the road plate, and a boot mounted on the shaft and arranged to the road plate to an underground utility valve box or the like;

DETAILED DESCRIPTION OF THE DRAWINGS

Figure 2:
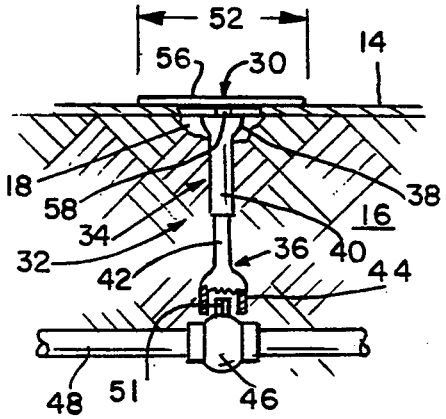
FIG. 2 is a side elevational view of a booted road plate assembly in accordance with one embodiment of the invention covering an excavated area around a utility valve box.

A booted road plate 30 according to a first embodiment of the present invention is shown in FIG. 2 in its installed position in the ground. The booted road plate 30 is placed over an excavated repair area 18 around a utility valve box 32. The utility valve box 32 includes a top half 34 and a bottom half 36. The top half 34 includes a bell 38 and an upper sleeve 40 and the bottom half 36 includes a lower sleeve 42 and a foot 44. The valve box 32 is positioned vertically between the roadway surface 14 and a valve 46 mounted in an underground pipeline 48. The valve box 32 is formed to include a passageway 50 extending through the top half 34 and bottom half 36. The passageway 50 can be used to enable a utility worker to insert a key (not shown) into the underground valve 46. A key is a long T-shaped device that extends down through the passageway 50 and attaches to an operating nut 51 on the valve 46. This allows a worker, standing on the roadway surface 14, to actuate the valve 46 using the key to turn the operating nut 51 which moves the valve 46 between an open and closed position to control the flow of liquid, gas, etc. through the underground pipeline 48.

Occasionally, it is necessary to excavate the ground 16 surrounding the utility valve box 32 during repair of the utility valve box 32. The booted road plate 30 is used to cover the excavated repair area 18 around the utility valve box 32. The booted road plate 30 is anchored in the passageway 50 of the utility valve box 32 to resist movement caused by vehicles traveling on the roadway surface 14.

Figure 1:
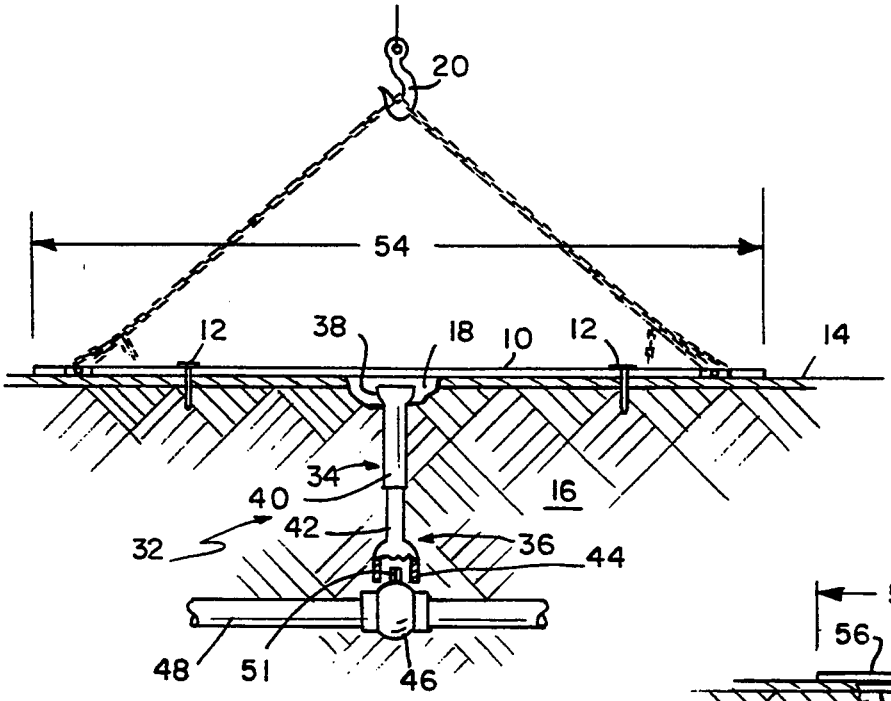
FIG. 1 is a side elevational view of a conventional road plate assembly covering an excavated area around a utility valve box showing a mechanized lifting device used to move the road plate assembly.

The relative size of the booted road plate 30 compared to a conventional large steel plate 10 is illustrated in FIGS. 1 and 2. The ability of the booted road plate 30 to anchor into a passageway 50 formed in the utility valve box 32 or other underground conduit allows dimension 52 of the booted road plate 30 to be much smaller than dimension 54 of the large steel plate 10. The small dimension 52 of the booted road plate 30 minimizes labor and equipment cost associated with roadway repair involving excavated holes which must be covered temporarily by a road plate of some sort.

Figure 3:
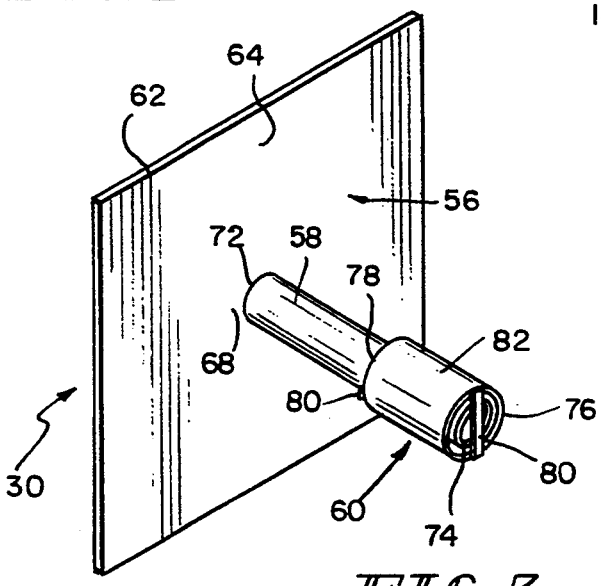

The components of the booted road plate 30 are illustrated in FIG. 3. The booted road plate 30 includes a plate 56 used to cover the excavated repair area 18, a shaft 58 appended to the plate 56 and arranged to extend downwardly into the passageway 50 of the utility valve box 32, and a boot 60 appended to the shaft 58 to anchor the booted road plate 30 in the valve box 32. One advantage of the booted road plate 30 is that an excavated repair area 18 around a valve box 32 can be covered with a booted road plate 30 having a minimum weight and size to allow ease of installation and transportation of the booted road plate 30 to and from the work site.

Figure 4:
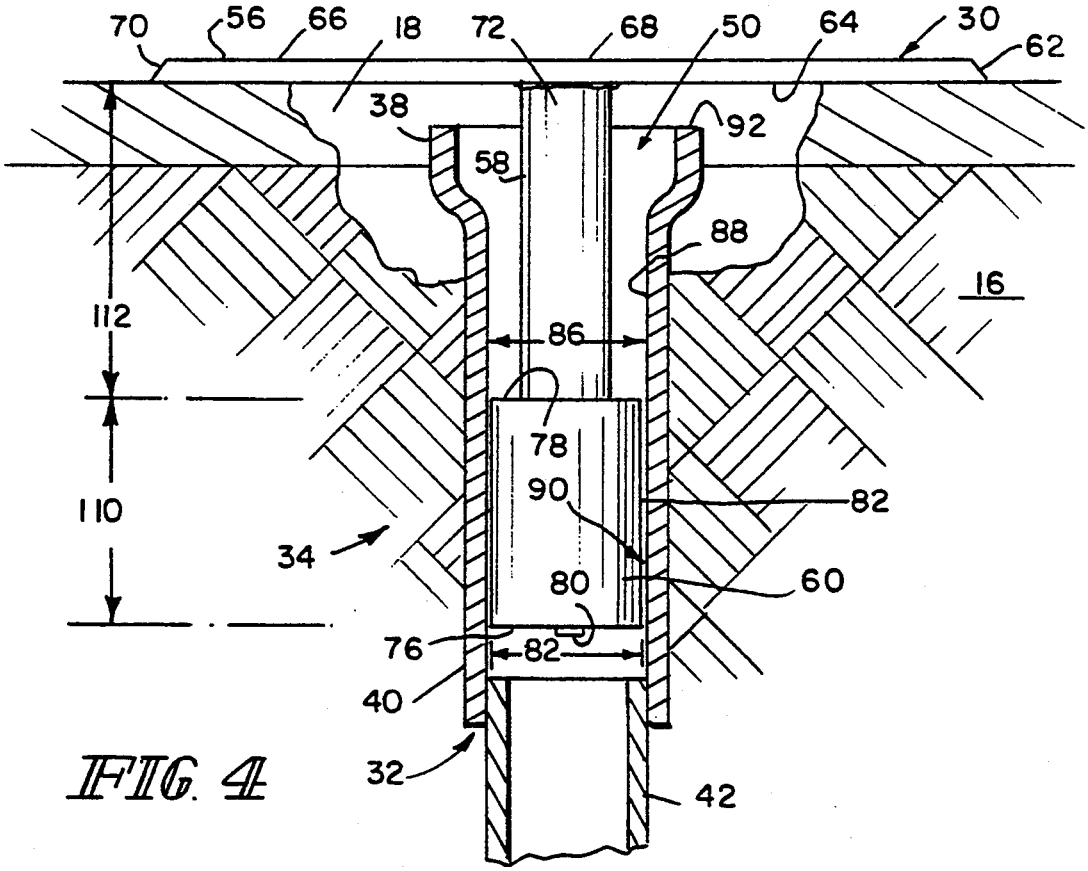
FIG. 4 is a sectional view of the road plate assembly of FIG. 3 following installation in an underground utility valve box to cover an excavated area around the utility valve box and showing a bell formed on the upper end of the utility valve box.
Figure 5:
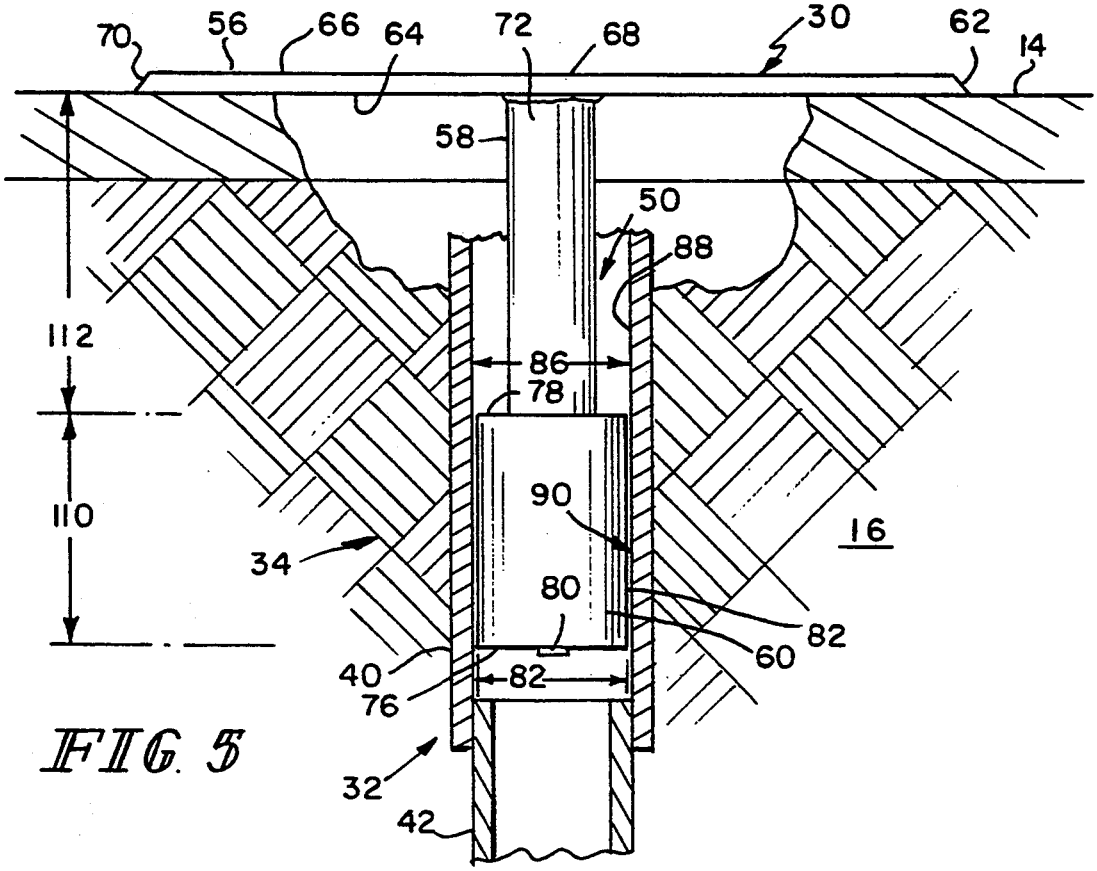
FIG. 5 is a sectional view of the road plate assembly of FIG. 3 installed in a utility valve box that has its bell removed.
Figure 6:
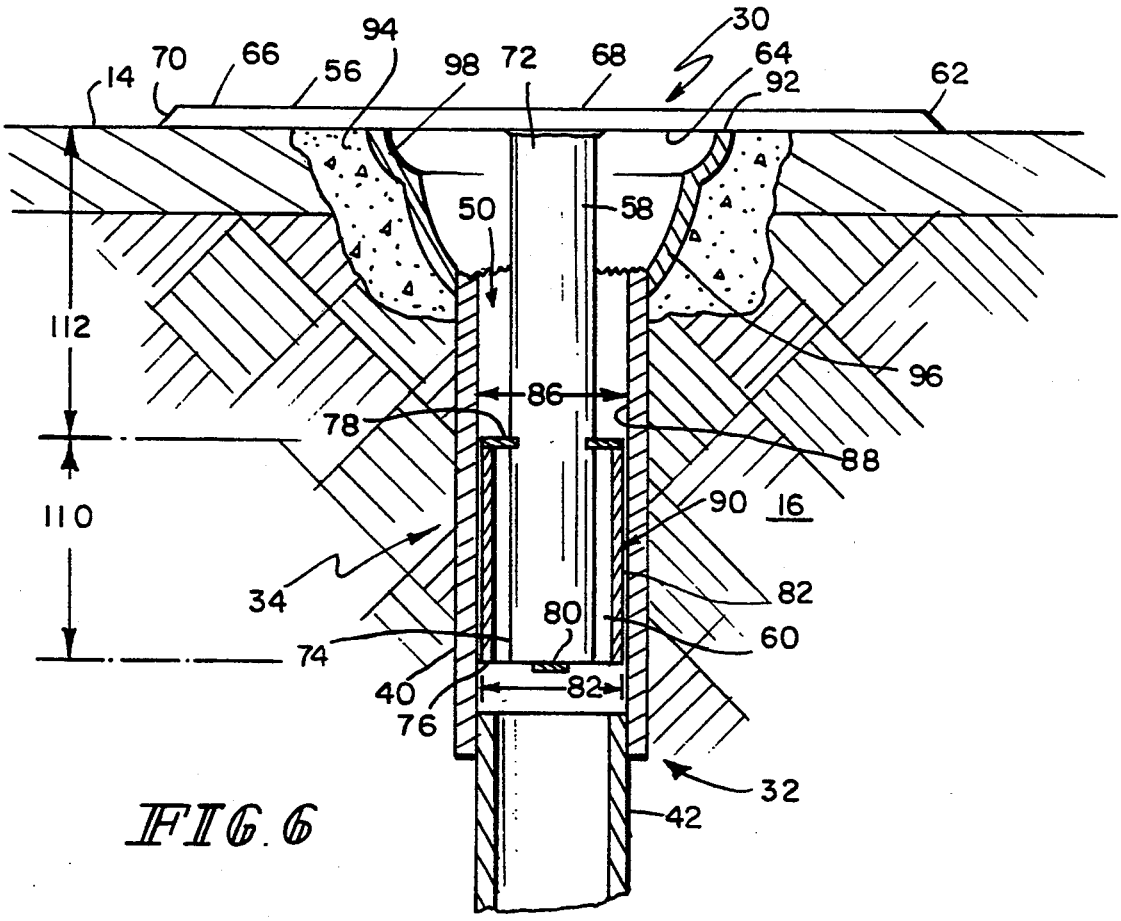
FIG. 6 is a sectional view of the road plate assembly of FIG. 3 installed in a utility valve box and arranged to cover concrete that is curing and surrounding the utility valve box.

The plate 56 includes a perimeter edge 62, a bottom side 64, top side 66, and a central region 68, as shown in FIGS. 4–6. The bottom side 64 faces downwardly toward the roadway surface 14 and the top side 66 faces upwardly away from the roadway surface 14 to support roadway traffic. The perimeter edge 62 includes a beveled surface 70 to reduce the impact created by the roadway traffic. The central region 68 is the portion of the plate 56 that covers the utility valve box 32. The plate 56 has dimensions of approximately 2 feet×2 feet (0.61 meters×0.61 meters) and weighs approximately 70 lbs. (31.8 Kg). The dimensions and weight of the booted road plate 30 will differ according to the size of the utility valve box 32 or the like. In the illustrated embodiment, the plate 56 is made from steel. However, alternative embodiments may use plates 56 constructed from any rigid material.

The shaft 58 includes a proximal end 72 welded to the bottom side 64 of the plate 56 in the central region 68. The shaft 58 extends downwardly from the plate 56 into the utility valve box 32 to a distal end 74. The shaft 58 is hollow and cylindrical in shape and made from steel. However, alternative embodiments may use shafts 58 of different shape and form.

The boot 60 includes a bottom side 76 appended to the distal end 74 of the shaft 58 and a top side 78 appended to the shaft 58 at a location between the distal end 74 and proximal end 72 on the shaft 58. The boot 60 is hollow, cylindrical in shape, and arranged to lie in coaxial relation to the shaft 58. The boot 60 is appended to the shaft 58 with struts 80 at the top side 78 and bottom side 76 of the boot 60. The struts 80 are strips of steel welded to the boot 60 and the shaft 58 to hold the boot 60 stationary relative to the shaft 58. The boot 60 has an outer annular wall 82 with a diameter 84 approximately 0.25 inches (0.635 centimeters) less than the diameter 86 of an inner surface 88 of the utility valve box 32.

The boot 60 fits snugly in the passageway 50 defined inside the inner surface 88 of the utility valve box 32 to allow engagement of the boot 60 and inner surface 88 as shown, for example, in FIG. 4. This engagement allows forces imparted on the plate 56 to be transmitted to the utility valve box 32 at a point deep down away from the road plate 56, roadway surface 14, and portions of the utility valve box 32 in the area under repair 18. However, enough of a gap 90 exists between the outer annular wall 82 of the boot 60 and inner surface 88 of the utility valve box 32 to allow easy installation and removal of the booted road plate 30 by a single road worker. In the illustrated embodiment, the boot 60 is made from steel. However, in alternative embodiments, the boot 60 may be made from any rigid material.

Repair work on the utility valve box 32 is performed usually to replace a faulty valve box 32, raise a top level 92 of the valve box 32 to the roadway surface 14 after street resurfacing, or gain access to valve boxes 32 which have been paved over during street resurfacing. The work associated with raising the top level 92 of the valve box 32 to the roadway surface 14 is illustrated in FIGS. 4–6. To perform this task the area around the utility valve box 32 is excavated, as shown in FIG. 4. After excavation is completed, the bell 38 is removed to allow a first riser 96 and a second riser 98 to be attached to the upper sleeve 40 so that the top level 92 of the large bell 38 is even with the roadway surface 14, as shown in FIG. 5. The next step is to attach the first and second riser 96, 98 to the utility valve box 32. The final step is to pour concrete 94 around the utility valve box 32 and allow it to cure, as shown in FIG. 6. Completion of this repair process will cover many periods of time when repair work is not being conducted due to nights, weekends, bad weather, time for concrete to cure, etc. Use of the booted road plate 30 allows traffic to pass over the excavated repair area 18 during the time periods when repair work is not being conducted.

The protection of the concrete 94 and the first and second riser 96, 98 is crucial when the concrete is curing to ensure that the concrete 94 and the first and second riser 96, 98 are not damaged or moved out of their proper positions. The booted road plate 30 protects the concrete 94 and the first and second riser 96, 98 by directing forces due to roadway traffic away from the repair area 18 and transferring them to a contact zone 110 located a distance 112 down and away from the roadway surface 14. The diameter 84 of the boot 60 is larger than a diameter 59 of the shaft 58 to allow only the boot 60 to engage the inner surface 88 of the utility valve box 32. Therefore, the contact zone 110 is limited to the area where the outer annular wall 82 of the boot 60 engages the inner surface 88 of the utility valve box 32. The contact zone 110 is located the distance 112 from the roadway surface 14 to prevent the forces acting on the plate 56 from impairing the condition of the repair area 18 and damaging or moving upper portions of the utility valve box 32 before the concrete 94 cures.

In the illustrated embodiment, the first and second risers 96, 98 are used to raise the top level 92 of the utility valve box 32 to the roadway surface 14. However, in alternative embodiments any number of risers 96, 98, adapters, bells 38, or repair parts may be used to raise the top level 92 of the utility valve box 32 to the roadway surface 14.

Figure 7:
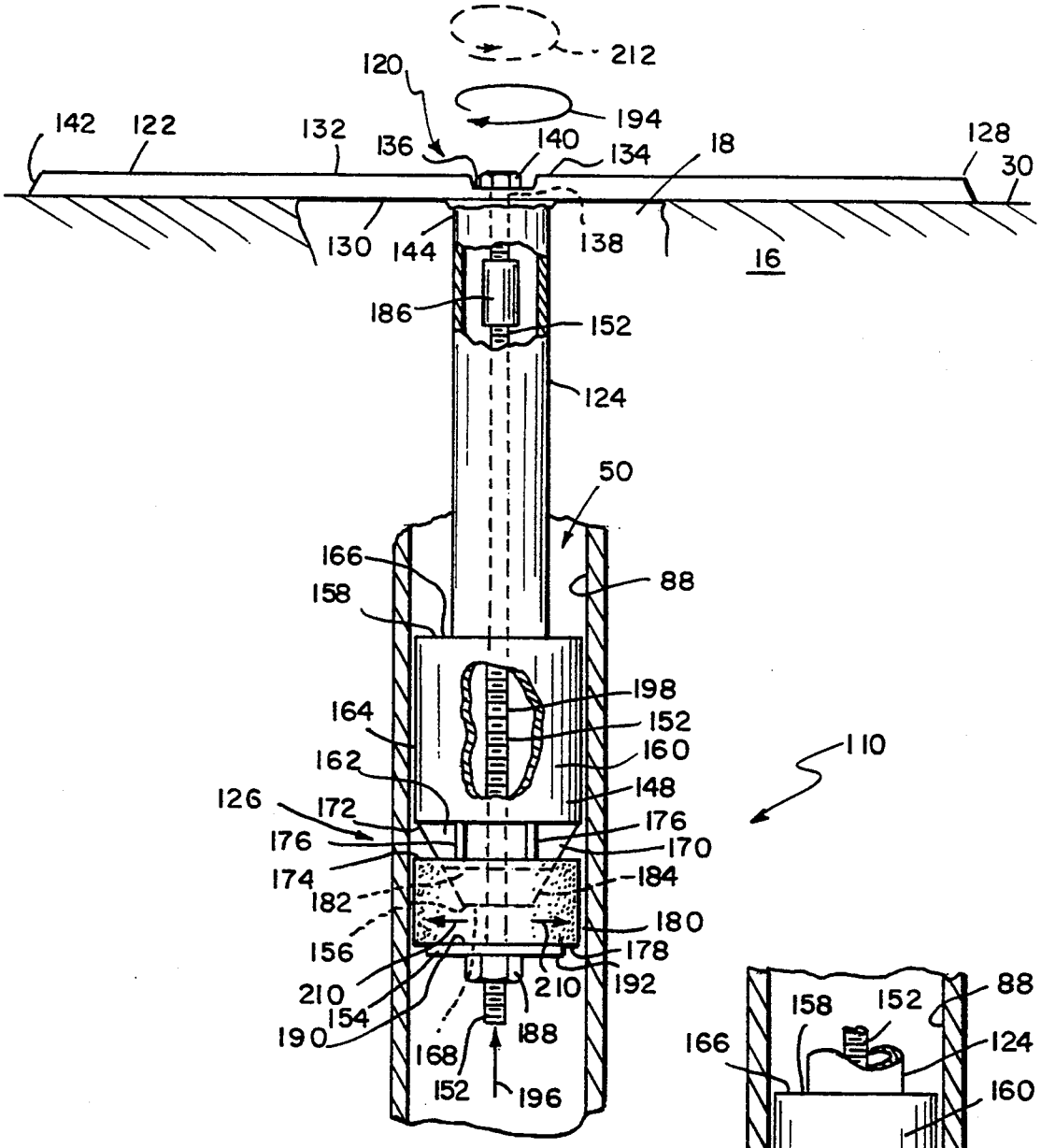
FIG. 7 is a sectional view similar to FIG. 4, with portions broken away, of an alternative embodiment of the present invention and showing a road plate for covering the excavated area, a shaft attached to the underside of the road plate, an expandable boot, and a threaded rod for expanding the expandable boot to anchor the road plate assembly in a fixed position in a utility valve box.
Figure 8:
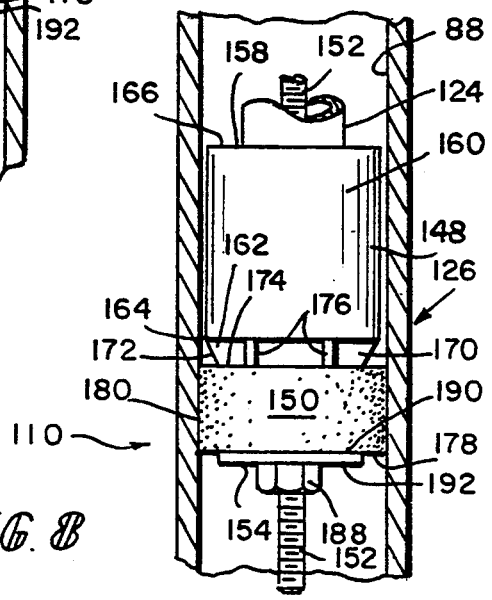
FIG. 8 is a detail view of the road plate assembly of FIG. 7 showing the expandable boot and boot-expanding member in an anchored position in a utility valve box.

An alternative embodiment of a booted road plate 120 is shown in FIGS. 7 and 8. The booted road plate 120 includes a plate 122 covering an excavation area 18 around a utility valve box 32, a shaft 124 appended to the plate 122, and a boot assembly 126 for retaining the booted road plate 120 in position over the utility valve box 32.

The plate 122 includes a perimeter edge 128, a bottom side 130, a top side 132, and a central region 134. The bottom side 130 faces downwardly toward the roadway surface 14 and the top side 132 faces upwardly away from the roadway surface 14 to support roadway traffic. The central region 134 is the portion of the plate 122 that covers the utility valve box 32. The top side 132 includes a recess 136 in the central region 134 with an aperture 138 concentric to the shaft 124 for receiving a bolt 140. The perimeter edge 128 includes a beveled surface 142 to reduce the impact created by roadway traffic. The plate 122 has dimensions of approximately 2 feet×2 feet (0.61 meters×0.61 meters) and weighs approximately 70 lbs. (31.8 Kg). In the illustrated embodiment, the plate 122 is made from steel. However, alternative embodiments may use plates 122 constructed from any rigid material.

The shaft 124 includes a proximal end 144 appended to the bottom side 130 of the plate 122 in the central region 134. The shaft 124 extends downwardly from the plate 122 into the utility valve box 32 to a distal end. The shaft 124 is hollow, cylindrical in shape and made from steel. However, alternative embodiments may use shafts 124 of different shapes and forms and may be constructed from any rigid material.

The boot assembly 126 includes a boot-expanding member or tapered boot 148, an expandable boot or expansion boot 150, a threaded rod 152, and a compression plate 154. The boot-expanding member 148 includes a bottom side 156 appended to the distal end of the shaft 124 and a top side 158 appended to the shaft 124 between the distal end and the proximal end 144 of the shaft 124. The boot-expanding member 148 is appended to the shaft 124 with struts (not shown) on the top side 158 and the bottom side 156 of the boot-expanding member 148. The struts are strips of steel welded to the boot-expanding member 148 and the shaft 124 to hold the boot-expanding member 148 stationary relative to the shaft 124.

The boot-expanding member 148 includes a cylindrical portion 160 and a conical portion 162. The cylindrical portion 160 begins at the top side 158 of the boot-expanding member 148 and extends downwardly to a junction 164 between the top side 158 and bottom side 156 of the boot-expanding member 148. The conical portion 162 extends from the junction 164 to the bottom side 156 of the boot-expanding member 148. The boot-expanding member 148 includes a large side 166 facing the plate 122 and a small side 168 facing away from the plate 122. The conical portion 162 is wedge-shaped 170 and has an annular cam wall 172 that diverges radially outward as the annular cam wall 172 approaches the plate 122. The annular cam wall 172 includes four alignment ridges 176 engaged with the expandable boot 150.

The expandable boot 150 includes a top side 174 facing the annular cam wall 172 of the boot-expanding member 148, a bottom side 178 facing downwardly into the utility valve box 32, and an outer annular wall 180 facing toward the inner surface 88 of the utility valve box 32. The top side 174 includes a recess 182 having a cam follower wall 184 that is engaged with the alignment ridges 176. The threaded rod 152 is coupled to the bolt 140 with a threaded coupling 186. The threaded rod 152 extends downwardly from the threaded coupling 186 through the shaft 124 and into threaded engagement with the compression plate 154 and a compression nut 188. The compression plate 154 includes a top side 190 appended to the bottom side 178 of the expandable boot 150 and a bottom side 192 facing downwardly into the utility valve box 32. The compression nut 188 is appended to the bottom side 192 of the compression plate 154.

To anchor the booted road plate 120 in the utility valve box 32, the bolt head 140 is rotated in clockwise direction 194. The alignment ridges 176 on the annular cam wall 172 are engaged with the cam follower wall 184 to create friction between the walls 172, 184 so that the rotational movement raises the expandable boot 150 in direction 196 rather than rotate the expandable boot 150 with the threaded rod 152. In alternative embodiments, any structure which creates friction between the annular cam wall 172 and cam follower wall 184 may be used in place of the alignment ridges 176. When bolt head 140 is rotated in a clockwise direction 194 the threaded rod 152 acts as a linkage 198 to raise the expandable boot 150 in direction 196 and into compressive engagement with the axially fixed boot-expanding member 148. Once the boot-expanding member 148 and expandable boot 150 are squeezed together in compressive engagement, the annular cam wall 172 engages the cam follower wall 184 to move the expandable boot 150 in a radially outwardly expanded direction 210 to anchor the shaft 124 in the utility valve box 32, as shown in FIG. 8. In the anchored position, the outer annular wall 180 of the expandable boot 150 engages with the inner surface 88 of the utility valve box 32 to transfer forces acting on the plate 122 to the contact zone 110. Transferring the forces acting on the plate 122 to the contact zone 110 prevents the forces from impairing the condition of the repair area 18. The engagement of the outer annular wall 180 and inner surface 88 prevents the booted road plate 120 from "bouncing" in the utility valve box 32 due to roadway traffic.

To remove the booted road plate 120 from the utility valve box 32, the bolt 140 is rotated in counterclockwise direction 212. This rotational movement lowers the expandable boot 150 away from the boot-expanding member 148 until the expandable boot 150 and boot-expanding member 148 are still engaged but no longer in compressive engagement. Once the boot-expanding member 148 and expandable boot 150 are no longer squeezed together in compressive engagement, the outer annular wall 180 of the expandable boot 150 and inner surface 88 of the utility valve box 32 are no longer engaged and the booted road plate 120 can be removed from the utility valve box 32.

In the illustrated embodiment, the plate 122, shaft 124 and boot-expanding member 148 are made from steel and the expandable boot 150 is made from rubber. In alternative embodiments, any rigid material may be used for the plate 122, shaft 124 and boot-expanding member 148 and the expandable boot 150 may be any structure which will expand when engaging a boot-expanding member 148.

In the illustrated embodiment, the booted road plate 30, 120 is anchored in the upper sleeve 40 of the utility valve box 32. However, in alternative embodiments, the booted road plate 30, 120 may be anchored in the lower sleeve 42 of the utility valve box 32.

In the illustrated embodiment, the booted road plate 30, 120 includes a plate 56, 122, a shaft 58, 124, and a boot 60 or boot assembly 126. However, in alternative embodiments the boot 60 or boot assembly 126 may be directly appended to the plate 56, 122 without using a shaft 58, 124.

In the illustrated embodiment, the booted road plate 30, 120 includes a rigid shaft 58, 124. However, in alternative embodiments any linkage device may be used to attach the boot 60 or boot assembly 126 to the plate 56, 122.

Although this invention has been described in detail with reference to certain embodiments, variations and modifications exist within the scope and spirit of the invention as described and as defined in the following claims.

I claim:

1. A road plate assembly for covering a predetermined underground positions the road plate assembly comprising a plate including a bottom side engaging the ground and a central region covering the underground position, and anchoring means for retaining the plate over the underground position, the anchoring means being appended to the bottom side of the plate in the central region and extending downwardly from the plate into the underground position, the anchoring means including a shaft having a proximal end appended to the bottom side of the plate and arranged to extend downwardly into the underground position a predetermined distance to a distal end of the shaft and a boot having a cylindrical periphery appended to the shaft at a location thereon spaced from the plate, and the boot having a diameter greater than that of the shaft and disposed in coaxial relation to the shaft.

2. The road plate assembly of claim 1 wherein the plate, shaft, and boot are rigid.

3. The road plate assembly of claim 1, wherein the shaft is rigidly connected to the plate and arranged so that the shaft is always oriented perpendicular to the plate.

4. The road plate assembly of claim 1, wherein the predetermined underground position is a cylindrical bore having an inner surface, the boot has a diameter slightly smaller than the inner surface of the underground position and is arranged to engage the inner surface of the underground position if a force is exerted on the plate.

5. The road plate of claim 1, wherein the plate includes a beveled perimeter edge.

6. The road plate assembly of claim 1, wherein the shaft and boot are hollow and cylindrical in shape.

7. The road plate of claim 1, wherein the anchoring means includes means for transmitting forces created by impact on the plate from the plate to an underground fixture located at the underground position through the shaft and the boot.

8. The road plate assembly of claim 1, wherein the anchoring means includes a shaft having a proximal end connected to the bottom side of the plate that extends downwardly into the underground position a predetermined distance.

9. The road plate assembly of claim 1, wherein the boot is appended to the distal end of the shaft and extends upwardly from the distal end of the shaft a predetermined distance to a location between the distal end and proximal end of the shaft.

10. A road plate assembly for covering a predetermined underground position, the road plate assembly comprising a plate including a bottom side engaging the ground and a central region covering the underground position, a shaft having a proximal end appended to the bottom side of the plate in the central region that extends downwardly from the plate a predetermined distance into the underground position to a distal end, and expanding means including a wedge and means for moving an expandable boot toward engagement with the wedge to expand the expandable boot to a radially outwardly expanded position anchoring the shaft in an underground position.

11. The road plate assembly of claim 10, wherein the means for moving includes a linkage passing through the shaft and means for rotating the linkage inside the shaft to move the expandable boot toward engagement with the wedge so that the expandable boot moves relative to the shaft to a radially outwardly expanded position anchoring the shaft in the underground position.

12. The road plate of claim 11, wherein the linkage includes a threaded rod having a head on a top side of the plate that extends downwardly through the shaft into threaded engagement with a compression plate appended to a bottom side of the expandable boot and arranged so that as the head is rotated, and the compression plate moves the expandable boot relative to the wedge.

13. The road plate assembly of claim 11, wherein the plate, shaft, and wedge are rigid and the expandable boot is resilient.

14. The road plate assembly of claim 10 wherein the wedge is appended to the distal end of the shaft and has walls diverging radially outward as the boot-expanding member extends toward the road plate.

15. The road plate assembly of claim 10, wherein the shaft is rigidly appended perpendicular to the plate.

16. The road plate assembly of claim 10, wherein the plate includes a beveled perimeter edge.

17. A road plate assembly for covering a predetermined underground position, the road plate assembly comprising a plate including a bottom side engaging the ground and a central region covering the underground position, a shaft having a proximal end appended to the bottom side of the plate in the central region that extends downwardly from the plate a predetermined distance into the underground position to a distal end, a boot assembly including an expandable boot, and control means for moving the expandable boot relative to the shaft to a radially outwardly expanded position anchoring the shaft in an underground position.

18. The road plate assembly of claim 17, wherein the boot assembly further includes a boot-expanding member axially fixed to the distal end of the shaft.

19. The road plate assembly of claim 17, wherein the control means includes a linkage passing through the shaft and means for rotating the linkage inside the shaft to move the expandable boot toward engagement with a boot-expanding member so that the expandable boot moves relative to the shaft to a radially outwardly expanded position anchoring the shaft in the underground position.

20. The road plate of claim 19, wherein the boot-expanding member is wedge-shaped to provide cam means for expanding the expandable boot to a radially outwardly expanded position to anchor the shaft in the underground position once the linkage moves the expandable boot toward engagement with the boot-expanding member, and the cam means includes the wedge-shaped boot-expanding member fitting into a recessed portion of the expandable boot.

21. The road plate of claim 20, wherein the boot-expanding member has walls diverging radially outward as the boot-expanding member extends toward the road plate.

22. The road plate of claim 19, wherein the linkage includes a threaded rod having a head on a top side of the plate that extends downwardly through the shaft into threaded engagement with a compression plate appended to a bottom side of the expandable boot and arranged so that as the head is rotated, and the compression plate moves the expandable boot relative to the boot-expanding member.

23. A road plate assembly for covering a predetermined underground position, the road plate assembly comprising a plate including a bottom side engaging the ground and a central region covering the underground position, and anchoring means for retaining the plate over the underground position, the anchoring means being appended to the bottom side of the plate in the central region and arranged to extend downward into the underground position, the anchoring means including means for engaging an inner surface of the underground position, the anchoring means further including a hollow shaft having a proximal end appended to the bottom side of the plate that extends a predetermined distance into the underground position to a distal end, a boot assembly including a boot-expanding member having a bottom side appended to the distal end of the shaft and arranged to extend upwardly toward the plate to a top side located between the distal end and proximal end of the shaft and an expandable boot engaged with the boot-expanding member having a top side facing the distal end of the boot-expanding member and a bottom side facing downwardly into the underground position, and lifting means for moving the expandable boot into compressive engagement with the boot-expanding member, the boot-expanding member having a diameter greater than that of the shaft on the top side and a diameter equal to the shaft on the bottom side.

24. The road plate assembly of claim 23, wherein the lifting means includes a threaded rod appended on the top side of the plate and arranged to extend through the shaft and into threaded engagement with a compression plate and nut, the compression plate is appended to the bottom side of the expandable boot, and the threaded rod is arranged so that imparting rotational movement to the threaded rod on the top side of the plate moves the expandable boot into compressive engagement with the boot-expanding member.

25. The road plate assembly of claim 23, wherein the boot assembly includes cam means for extending the expandable boot to a radially expanded position to provide the means for engaging the inner surface of the shaft to anchor the shaft in the underground position once the expandable boot is moved into compression engagement with the boot-expanding member, and the cam means includes a cam wall on the distal end of the boot-expanding member engaging a cam follower wall on the top side of the expandable boot.

26. The cap of claim 25, wherein alignment ridges on the cam wall of the boot-expanding member always maintain contact with the expandable boot.

27. The cap of claim 25, wherein the top side of the expandable boot includes a recess and the cam follower wall is the surface of the recessed area.

28. A system for covering an excavation area around a utility valve box in a roadway, the system comprising a plate including a top side arranged to support roadway traffic, a bottom side engaging the roadway surface and a central region covering the utility valve box, and anchoring means appended to the bottom side of the plate in the central region for retaining the plate over the excavation area, the anchoring means including means for engaging an inner surface of the utility valve box to retain the plate over the excavation area by transmitting fortes created by roadway traffic impacting on the plate to the utility valve box, the anchoring means including a shaft having a proximal end appended to the bottom side of the plate in the central region and arranged to extend downwardly into the utility valve box a predetermined distance to a distal end and a boot appended to the distal end of the shaft, the engaging means including an outer annular wall of the boot having a diameter larger than the shaft and smaller than the inner surface of the utility valve box, and the outer annular wall being arranged to engage the inner wall of the utility valve box when a force attempts to move the plate away from its position over the excavated area.

29. A method of covering an excavation area around a utility valve box in a roadway, the method comprising the steps of providing a booted road plate including a plate having a bottom side engaging the roadway and a top side supporting roadway traffic, a shaft having a proximal end non-rotatably appended to the bottom side of the plate and arranged to extend downward into the utility valve box to a distal end, and a boot appended to the distal end of the shaft having a diameter larger than that of the shaft and disposed in coaxial relation to the shaft, and inserting the shaft and boot into the utility box until the bottom side of the plate engages the roadway and the boot extends into the utility box for peripheral engagement with a portion thereof.

30. A system for covering an excavation area around a utility valve box in a roadway, the system comprising a pipe having a top side at the surface of the roadway and arranged to extend downwardly into the ground, a plate including a bottom side covering the excavation area around the pipe, a top side supporting roadway traffic, and a central region covering the pipe, a shaft having a proximal end appended to the bottom side of the plate in the central region and arranged to extend downwardly into the pipe to a distal end, and a boot appended to the distal end of the shaft and configured to include means for engaging an inner surface of the pipe so that forces created by roadway traffic are transmitted from the plate to the pipe through the shaft and boot, the engaging means including an outer annular wall of the boot having a diameter greater than the shaft and smaller than the inner surface of the pipe.

31. A road plate assembly for covering a predetermined underground position, the road plate assembly comprising a plate including a bottom side engaging the ground and a central region covering the underground position, a shaft having a proximal end appended to the bottom side of the plate in the central region that extends downwardly from the plate a predetermined distance into the underground position to a distal end, an expandable boot, a wedge, and means for moving the expandable boot in a first direction toward engagement with the wedge to expand the expandable boot to a radially outwardly expanded position anchoring the shaft in an underground position and in a second direction away from engagement with the wedge to contract the expandable boot to a radially inwardly contracted position releasing the shaft from the underground position.

32. A road plate assembly for covering a predetermined underground position, the road plate assembly comprising a plate including a bottom side covering the underground position, and anchoring means for retaining the plate over the underground position, the anchoring means being appended to the bottom side of the plate and extending downwardly from the plate into the underground position, the anchoring means including a shaft having a proximal end appended to the bottom side of the plate and arranged to extend downwardly into the underground position a predetermined distance to a distal end of the shaft and a boot having a cylindrical periphery appended to the shaft at a location thereon spaced from the plate, and the boot having a diameter greater than that of the shaft and disposed in coaxial relation to the shaft.

* * * * *